US005138912A

United States Patent [19]

Dyke

[11] Patent Number: 5,138,912

[45] Date of Patent: Aug. 18, 1992

[54] LOCKING PIPE WRENCH

[76] Inventor: Harold J. Dyke, P.O. Box 20, Adel, Oreg. 97620

[21] Appl. No.: 738,553

[22] Filed: Jul. 31, 1991

[51] Int. Cl.[5] ..... B25B 7/12

[52] U.S. Cl. ..... 81/363; 81/356; 81/376; 81/390

[58] Field of Search ..... 81/352-356, 81/361-363, 373, 375-377, 347, 387, 390, 395, 402, 383.5, 155, 165-169

[56] References Cited

U.S. PATENT DOCUMENTS 952,079 3/1910 McIntire .
1,678,216 7/1928 Greer .
2,391,604 12/1945 Wallace .
2,397,239 3/1946 Brown .
3,285,107 11/1966 Kasper .

*Primary Examiner*—D. S. Meislin
*Attorney, Agent, or Firm*—Donald A. Kettlestrings

[57] ABSTRACT

A locking pipe wrench includes an upper movable jaw and a lower jaw attached to a toggle assembly whereby work can be firmly clamped and held between the jaws by adjusting the position of the upper jaw and by locking the lower jaw into position against the work by means of the toggle assembly.

15 Claims, 2 Drawing Sheets

LOCKING PIPE WRENCH

This invention relates to wrenches and more particularly to a locking pipe wrench having an upper movable jaw and a lower toggle-actuated jaw.

An object of the present invention is to provide a locking wrench that is easy to use and inexpensive to manufacture.

Another object is to provide a quick-acting locking pipe wrench.

A further object of the invention is the provision of a locking wrench that will quickly and firmly grasp work positioned between the jaws of the wrench.

Additional objects and advantages of the invention will be set forth in part in the description which follows, and in part will be obvious from the description, or may be learned by practice of the invention. The objects and advantages are realized and attained by means of the instrumentalities and combinations particularly pointed out in the appended claims.

To achieve these and other objects the present invention provides a wrench having a handle; a sleeve element connected to the handle and defining a first opening; an upper jaw; a shank attached to the upper jaw and extending through the first opening; means in operative relationship with the shank, with the sleeve element and with the handle for adjustably positioning the shank with respect to the sleeve element; a connecting element rotatably attached to the sleeve element; a lower jaw independent from the handle and attached to the connecting element in opposed relationship with the upper jaw; a lever handle rotatably attached to the connecting element; at least one toggle link rotatably attached to and between the lever handle and the handle; and a release lever rotatably attached to the handle and in operative relationship with the lever handle for selectively contacting the lever handle to move the lever handle from a locked position to an unlocked position as the release lever is rotated toward the lever handle.

It is to be understood that both the foregoing general description and the following detailed description are exemplary and explanatory but are not restrictive of the invention.

The accompanying drawings, which are incorporated in and constitute a part of this specification, illustrate an example of a preferred embodiment of the invention and, together with the description, serve to explain the principles of the invention.

Figures 1, 5:
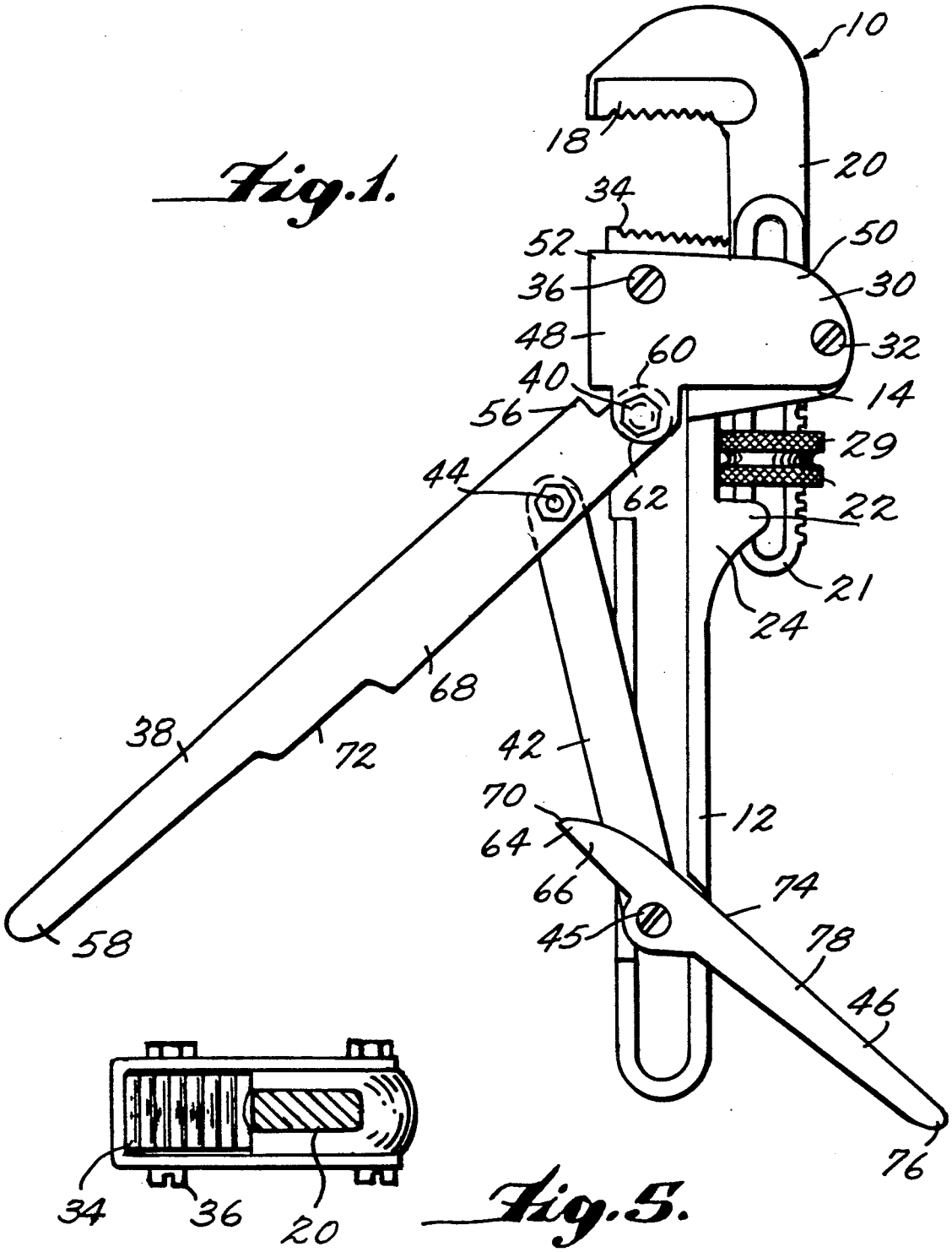
FIG. 1 is a side elevation view, partly in phantom, showing the wrench in the unlocked or open position.
FIG. 5 is a cross-sectional view taken along the line 5—5 in FIG. 2 and looking in the direction of the arrows.

With reference now to the drawings, wherein like reference characters designate like or corresponding parts throughout the several views, there is shown a pipe wrench 10 in accordance with the invention. Wrench 10 includes a handle 12, and a sleeve element 14 is connected to handle 12 and defines a first opening 16 therein in a conventional manner.

An upper jaw 18 is provided with a shank 20 attached to upper jaw 18, and shank 20 extends through opening 16 in the conventional manner for pipe wrenches.

Conventional means, generally indicated at 22, are provided in operative relationship with shank 20, with sleeve element 14 and with handle 12 for adjustably positioning shank 20 with respect to sleeve element 14. Means 22 typically include bosses 24, 24' projecting from handle 12 and positioned in opposition to each other to form a channel 26 therebetween for slidably receiving a lower portion 21 of shank 20. Means 22 also typically include conventional threads 28 on shank 20 and a knurled nut 29. Nut 29 has internal threads for engaging threads 28, and nut 29 is positioned above bosses 24, 24' and between the bosses and sleeve element 14 for limiting movement of the knurled nut. Rotation of nut 29 causes linear movement of shank 20 with respect to nut 29.

In accordance with the invention, a connecting element 30 is rotatably attached to sleeve element 14 by pin or bolt 32. A lower jaw 34, independent from handle 12, is attached to connecting element 30 in opposed relationship with upper jaw 18 by pin or bolt 36.

A lever handle 38 is rotatably attached to connecting element 30 by pins or bolts 40, 40'. Toggle links 42, 42' are rotatably attached to and between lever handle 38 and handle 12 by pins or bolts 44, 44' and 45, respectively.

A release lever 46 is rotatably attached to handle 12 by pin or bolt 45, and release lever 46 is in operative relationship with lever handle 38 for selectively contacting lever handle 38 to move the lever handle from a locked position (FIG. 2) to an unlocked position (FIG. 1) as the upper portion of release lever 46 is rotated toward lever handle 38.

In accordance with the invention, connecting element 30 preferably includes a yoke 48 having first and second opposed members 50, 50', each of members 50, 50' rotatably attached to sleeve element 14 by pin or bolt 32. Yoke 48 further includes a third member 52 connected between members 50, 50', and member 52 restricts movement of lower jaw 34 about pin or bolt 36.

Means, generally indicated at 54, are provided in operative relationship with lower jaw 34 and with yoke 48 for limiting downward movement of lower jaw 34 and yoke 48. More specifically, means 54 include upper end 55 of handle 12 for contacting and limiting downward movement of lower jaw 34, and means 54 include flange portions 57, 57' at the lower margin of sleeve element 14 for contacting lower edges 59, 59', respectively, of members 50, 50' and for limiting downward movement of yoke 48.

Figure 2:
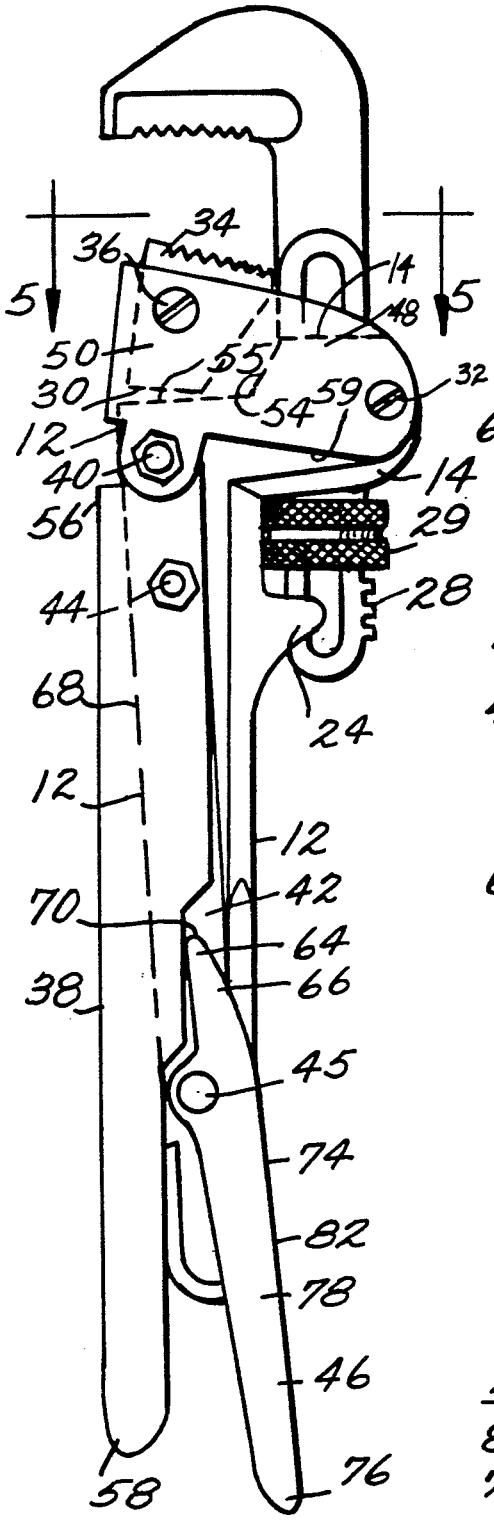
FIG. 2 is a side elevation view showing the wrench in the locked or closed position.
Figure 3:
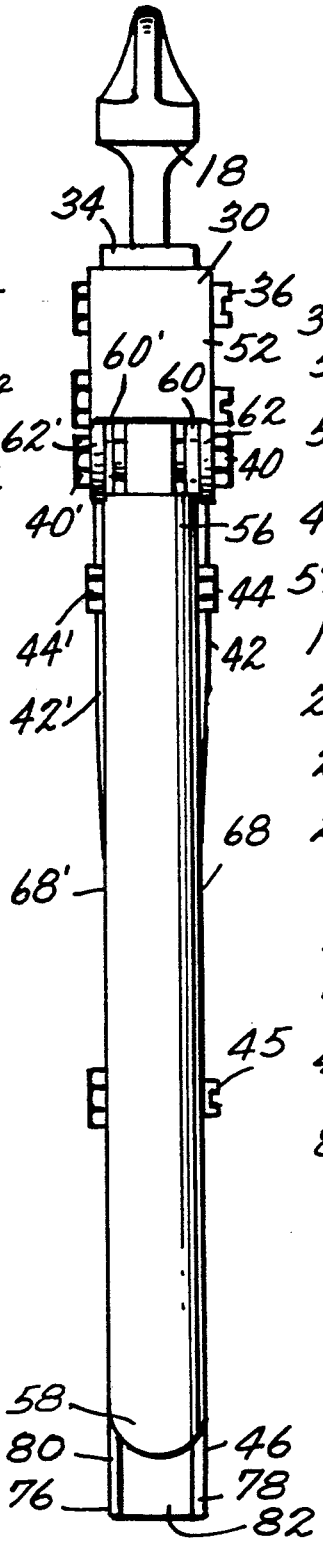
FIG. 3 is a front elevation view of the wrench in the locked position.
Figure 4:
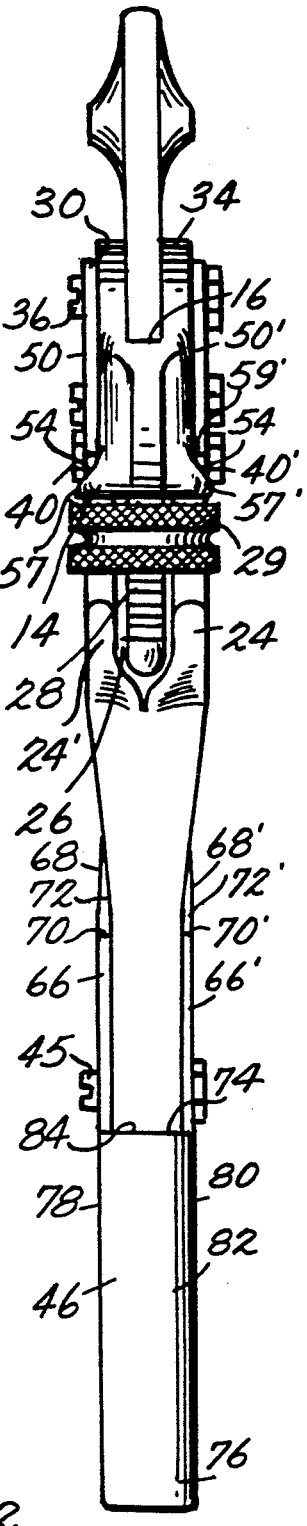
FIG. 4 is a rear elevation view showing the wrench in the locked position.

Lever handle 38 defines an upper end 56 and a lower end 58, and upper end 56 defines opposed bosses 60, 60' that are rotatably attached to opposed lugs 62, 62' of yoke 48 by pins or bolts 40, 40', respectively. Lever handle 38 is substantially channel-shaped in cross-section for enabling toggle links 42, 42' to be at least partially nestingly received within channel-shaped lever handle 38 when lever handle 38 is in a locked position (FIG. 2). This enables lever handle 38 to fit closely against and in complementary relationship with handle 12 so that the user of wrench 10 can simultaneously grasp handle 12 and lever handle 38 during use of the wrench.

Preferably, first and second toggle links 42, 42' are located, respectively, on opposite sides of handle 12, but it should be understood that one toggle link could be used to accomplish the intended result of this invention. Release lever 46 preferably defines a first yoke-shaped end 64, and yoke-shaped end 64 defines first and second opposed prong-shaped elements 66, 66'. First prong-shaped element 66 is positioned immediately adjacent to and in side-by-side relationship with respect to first toggle link 42, and second prong-shaped element 66' is positioned immediately adjacent to and in side-by-side relationship with respect to second toggle ' link 42'.

In accordance with the invention, channel-shaped lever handle 38 defines first and second opposed sidewalls 68, 68', and each of sidewalls 68, 68' is shaped to receive respective of prong-shaped elements 66, 66' in nesting relationship when lever handle 38 is in a locked position (FIG. 2). Each of prong-shaped elements 66, 66' defines a rounded end 70, 70', respectively for slidably engaging edge portions 72, 72' of sidewalls 68, 68', respectively.

Release lever 46 further includes a stop member 74 for selectively engaging handle 12 to limit rotational movement of release lever 46 in a clockwise direction and in a counter-clockwise direction. Release lever 46 defines a second channel-shaped end 76 for enabling handle 12 to be at least partially received in nesting relationship within channel-shaped end 76 when lever handle 38 is in a locked position (FIG. 2). This will enable the user of the wrench to comfortably grasp around release lever 46, handle 12 and lever handle 38, simultaneously, when wrench 10 is in use in the locked position.

Channel-shaped end 76 of release lever 46 defines a third sidewall 78 extending in substantially coplanar relationship from first prong-shaped element 66, and a fourth sidewall 80 extends in substantially coplanar relationship from second prong-shaped element 66'. Stop member 74 includes a substantially flat element 82 which extends between and is connected to sidewalls 78, 80. Flat element 82 defines an upper end edge 84 which is positioned to engage handle 12 and to limit rotational movement of release lever 46 when release lever 46 has moved lever handle 38 from a locked position (FIG. 2) to an unlocked position (FIG. 1). Flat element 82 also contacts handle 12 to limit rotational movement of release lever 46 in an opposite direction when wrench 10 is manipulated into a locked position (FIG. 2).

In operation, wrench 10 is manipulated to the unlocked position shown in FIG. 1. A pipe or other work piece (not shown) is then positioned between jaws 18 and 34. Upper movable jaw 18 is then adjusted in position with respect to the pipe or work piece in a conventional manner by turning knurled nut 29 until upper jaw 18 moves downwardly and into contact with the pipe or other work piece while lower jaw 34 is also in contact with the pipe or other work piece.

The operator then moves lever handle 38 toward handle 12 until handle 12 is positioned in nesting relationship within the channel-shaped cross-section of lever handle 38. As lever handle 38 is moved toward handle 12, lever handle 38 is rotated about pins or bolts 40, 40', and toggle links 42, 42' are rotated about pins or bolts 44, 44' and 45 until toggle links 42, 42' are positioned substantially in alignment with and immediately adjacent to the opposite sides of handle 12. When toggle links 42, 42' are so positioned, wrench 10 is in the locked position shown in FIG. 2.

Movement of lever handle 38 toward handle 12 and the resultant rotation of toggle links 42, 42' creates an upward force against yoke 48, and that force is transmitted through yoke 48 to lower jaw 34 whereby increased force is provided by lower jaw 34 against the pipe or other work piece positioned between jaws 18 and 34.

When wrench 10 is in the locked position, shown in FIG. 2, lever handle 38 is nested with handle 12 to create a convenient grasping means for the operator. In addition, flat element 82 of release lever 46 is positioned against handle 12, and handle 12 is nested within channel-shaped end 76 of release lever 46 to further create a convenient grasping means for the wrench operator. The operator's hand can easily grasp and surround handle 12, release lever 46 and lever handle 38 when wrench 10 is positioned in the locked configuration shown in FIG. 2.

When it is desired to release the wrench from the locked position, the operator grasps second end 76 of release lever 46. The operator then causes release lever 46 to be rotated about pin 45 so that rounded ends 70, 70' of prong-shaped elements 66, 66' engage edge portions 72, 72' of lever handle 38. The application by the operator of a slight force against second end 76 of release lever 46 causes prong-shaped elements 66, 66' to move against lever handle 38 and to cause the lever handle to be rotated about pins 40, 40' to an unlocked position shown in FIG. 1. This rotation of lever handle 38 to an unlocked position simultaneously causes toggle links 42, 42' to be rotated about pins 44, 44' and 45 to the unlocked position shown in FIG. 1.

When wrench 10 has been manipulated to the unlocked position shown in FIG. 1, the force of jaws 18 and 34 against the pipe or other work piece is reduced. Upper jaw 18 can then be conventionally moved away from the pipe or work piece by rotation of knurled nut 29, and the wrench can be removed from the pipe or other work piece.

The invention in its broader aspects is not limited to the specific details shown and described, and departures may be made from such details without departing from the principles of the invention and without sacrificing its chief advantages.

What is claimed is:

1. A wrench, comprising:

a handle;

a sleeve element connected to said handle and defining a first opening;

an upper jaw;

a shank attached to said upper jaw and extending through said first opening;

means in operative relationship with said shank, with said sleeve element and with said handle for adjustable positioning said shank with respect to said sleeve element;

a connecting element rotatably attached to said sleeve element;

a lower jaw independent from said handle and attached to said connecting element in opposed relationship with said upper jaw;

a lever handle rotatably attached to said connecting element;

at least one toggle link rotatably attached to and between said lever handle and said handle; and a release lever rotatably attached to said handle and in operative relationship with said lever handle for selectively contacting said lever handle to move said lever handle from a locked position to an unlocked position as said release lever is rotated toward said lever handle.

2. A wrench as in claim 1 wherein said connecting element includes a yoke having first and second opposed members, each of said members rotatably attached to said sleeve element, and a third member connected between said first and second members.

3. A wrench as in claim 2 further including means in operative relationship with said lower jaw for limiting downward movement of said lower jaw and said yoke.

4. A wrench as in claim 3 wherein said lever handle defines upper and lower ends and wherein said upper end is rotatably attached to said yoke.

5. A wrench as in claim 4 wherein said yoke defines first and second opposed lugs and wherein said upper end of said lever handle is rotatably attached to said lugs.

6. A wrench as in claim 5 wherein said lever handle is channel-shaped in cross-section for enabling said toggle link to be at least partially received within said channel-shaped lever handle when said lever handle is in said locked position.

7. A wrench as in claim 6 including first and second opposed said toggle links, said toggle links located, respectively, on opposite sides of said handle.

8. A wrench as in claim 7 wherein said release lever defines a first yoke-shaped end, said yoke-shaped end defining first and second opposed prong-shaped elements.

9. A wrench as in claim 8 wherein said first prong-shaped element is positioned immediately adjacent to said first toggle link and said second prong-shaped element is positioned immediately adjacent to said second toggle link.

10. A wrench as in claim 9 wherein said channel-shaped lever handle defines first and second opposed sidewalls of predetermined shape and wherein each of said sidewalls is shaped to receive respective of said prong-shaped elements in nesting relationship when said lever handle is in said locked position.

11. A wrench as in claim 10 wherein said prong-shaped elements each defines a rounded end for slidably engaging said sidewalls.

12. A wrench as in claim 11 wherein said release lever further includes a stop member for selectively engaging said handle to limit rotational movement of said release lever in a clockwise direction and a counterclockwise direction.

13. A wrench as in claim 12 wherein said release lever defines a second channel-shaped end for enabling said handle to be at least partially received within said channel-shaped end when said lever handle is in said locked position.

14. A wrench as in claim 13 wherein said channel-shaped end defines a third sidewall extending in substantially coplanar relationship from said first prong-shaped element, a fourth sidewall extending in substantially coplanar relationship from said second prong-shaped element, and said stop member extending between said third and fourth sidewalls.

15. A wrench as in claim 14 wherein said stop member includes a substantially flat element connected between said third and said fourth sidewalls, said flat element defining an upper end edge positioned to engage said handle to limit rotational movement of said release lever when said release lever has moved said lever handle from said locked to said unlocked position.

* * * * *